US006910996B1

(12) United States Patent
Patz

(10) Patent No.: US 6,910,996 B1
(45) Date of Patent: Jun. 28, 2005

(54) METHOD FOR PRODUCING A HONEYCOMB STRUCTURE AND APPARATUS THEREFOR

(76) Inventor: Nicholas John Patz, 1344 W. K St., Benicia, CA (US) 94501

( * ) Notice: Subject to any disclaimer, the term of this patent is extended or adjusted under 35 U.S.C. 154(b) by 0 days.

(21) Appl. No.: 10/670,938

(22) Filed: Sep. 25, 2003

Related U.S. Application Data

(60) Provisional application No. 60/414,265, filed on Sep. 27, 2002.

(51) Int. Cl.[7] ..... B31F 1/20
(52) U.S. Cl. ..... 493/463; 493/393; 156/205
(58) Field of Search ..... 493/374, 379, 493/380, 381, 382, 393, 394, 463; 156/197, 156/205, 462, 470

(56) References Cited

U.S. PATENT DOCUMENTS 2,609,314 A * 9/1952 Troxell et al. ..... 156/462
2,785,717 A * 3/1957 Knowles ..... 493/463
3,086,624 A * 4/1963 Wyatt ..... 156/205
3,481,830 A * 12/1969 Hanke ..... 156/462
3,738,905 A * 6/1973 Thomas ..... 156/462
3,887,418 A * 6/1975 Jurisich ..... 156/197
3,993,425 A * 11/1976 Dunn et al. ..... 493/463
4,188,253 A * 2/1980 Swartz ..... 156/462
4,267,223 A * 5/1981 Swartz ..... 428/172
5,296,280 A * 3/1994 Lin et al. ..... 156/197
5,498,462 A * 3/1996 Darfler ..... 428/116
5,735,986 A * 4/1998 Fell ..... 156/197
6,022,305 A * 2/2000 Choi et al. ..... 493/463

* cited by examiner

*Primary Examiner*—Louis Huynh
(74) *Attorney, Agent, or Firm*—Ted Masters

(57) ABSTRACT

A method and apparatus for producing a honeycomb structure in a continuous production process includes five process stations. At Station 1 sheets of deformable material are interleaved with a release ply to form a five layer sandwich. At Station 2 the five layer sandwich is corrugated. At Station 3 the two deformable sheets are separated and an adhesive is applied to one. At Station 4 the two deformable sheets are connected to form a single layer honeycomb structure. And at Station 5 a plurality of single layer honeycomb structures are cut and stacked to form a honeycomb structure of a desired thickness.

15 Claims, 9 Drawing Sheets

METHOD FOR PRODUCING A HONEYCOMB STRUCTURE AND APPARATUS THEREFOR

CROSS REFERENCE TO RELATED APPLICATION

This application claims the filing benefit under Title 35, United States Code, §119(e) of U.S. provisional application 60/414,265, filed Sep. 27, 2002.

TECHNICAL FIELD

The present invention generally pertains to honeycomb structures, and more particularly to a method and apparatus for corrugating and connecting deformable sheets to produce a honeycomb structure.

BACKGROUND OF THE INVENTION

The advantages of using composite honeycomb core in low-density sandwich structures have been well documented and understood for many years. Unfortunately the technology designed to produce such cores has not kept up with the advances in composite material technologies. The standard methods of composite core manufacturing tend to exhibit such problems as release residue in the inner core structure, non-uniform node adhesion, inaccurate geometrical structure, as well as a non-constant tg (glass transition temperature) throughout the volume. Due to these inadequacies of construction the structural and dielectrical properties of the core tend to be compromised.

The standard method for creating a composite core involves the stacking of aluminum rods over sheets of unidirectional or fabric prepreg. This process creates a large block of mostly aluminum that is generally heated in some form of a standard oven using convection as the method of heat transfer to the outer edges of the rods and then through conduction for the center of the block. The temperature curve with respect to block thickness will take tens of minutes to level off resulting in a non-even cure rate. Thus when the resin in the center of the block is just starting to advance the external edges could already be fully cured. This process will never be able to yield a core that has an even tg. The energy required to heat large blocks, tens of cubic feet, becomes astronomically large. When heating a large block the thermal difference from exterior to interior will result in differentials of thermal expansion. These differentials will show themselves as points of node separation as well as non-uniform cell size in which the structural, dielectrical and thermal advantages of the core are compromised.

A very large problem common with the aluminum rod composite core manufacturing process is due to the release agent applied to each aluminum rod which inherently a necessary step required to extract the rods from the core. The release agent tends to leave a silicon coating on the core. Structurally this inhibits a full bond between the core and skin of the structure. The residue also adversely affects the dielectrical properties of the core.

The lack on uniformity in cell geometry is a key factor in inhibiting the progression of composite honeycomb being applied to the field of R.F. cancellation in the aerospace market. Presently syntactic core is generally used due to its ease in dielectrical loading but structurally honeycomb core material is much more advantages. To control the dielectrical properties of composite honeycomb core, the core is created through an older method than previously stated, instead of using aluminum rods a nomex fabric is lightly impregnated with a resin, bonded at nodes and expanded much like the creation of an aluminum honeycomb core. The nomex style core is geometrically non-accurate and dialectically useless for R.F. cancellation. To make the core useful it is repeatedly dipped in a resin of particular dialectic properties until the desired effects are achieved. This works to a point but again dose not take advantage of the uniformity and controllability of the advance composite prepregs.

To overcome the aforementioned shortcomings, the present invention comprises a honeycomb production apparatus that will eliminate the present problems of composite core manufacturing and take full advantage of the advances in modern composite technologies.

The apparatus of the present invention produces composite honeycomb core through the corrugation of individual sheets of resin-impregnated fibers or fabric (prepreg). The corrugated sheets are stacked and adhered together using a node adhesive film. The resulting core will be extremely uniform, heat formable, absent of release residue, capable of extremely large ribbon lengths and will have dielectric properties controlled by the resin and fiber content.

SUMMARY OF THE INVENTION

The present invention is directed to a method and apparatus for producing a honeycomb structure wherein a continuous automated production process is employed. The process includes:

(a) providing a first sheet of deformable material stacked upon a second sheet of deformable material;

(b) passing the stacked first and second sheets of deformable material through a first conveyer (corrugator) wherein the first and second sheets of deformable material are corrugated by the first conveyor;

(c) separating the first sheet of corrugated deformable material from the second sheet of deformable material as they exit the first conveyor;

(d) applying an adhesive to the second sheet of deformable material;

(e) passing the first and second sheets of deformable material through a second conveyer wherein the corrugated first and second sheets of deformable material are connected to form a single layer honeycomb structure; and, (f) connecting a plurality of single layer honeycomb structures to form a honeycomb structure of a desired thickness.

The development of the present invention comprises a necessary step in the progression of advancing composite core technologies and signifies a significant leap in present honeycomb core construction technologies. The creation of geometrically accurate large heat formable composite honeycomb cores with customer specified resin and fiber properties at a cost comparable to standard composite honeycomb core opens the door to new honeycomb core applications in previously inapplicable fields.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
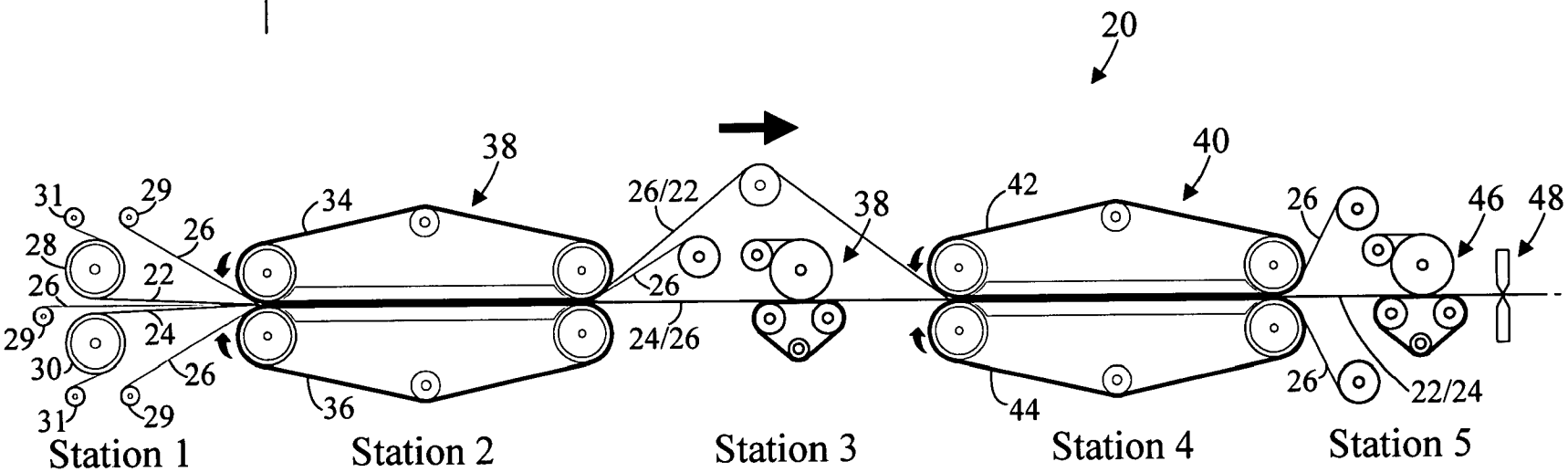
FIG. 1 is a side elevation view of a system for producing a honeycomb structure from sheet of deformable material in accordance with the present invention.

Referring initially to FIG. 1, there is illustrated a side elevation view of a system for producing a honeycomb structure from sheet of deformable material in accordance with the present invention, generally designated as 20. System 20 comprises a continuous production apparatus wherein elongated sheets of deformable material are automatically corrugated and then connected to form the honeycomb structure. System 20 has five Stations designated Station 1 through Station 5. In an embodiment of the invention, the deformable material is "prepreg" which is a resin based material available from YLA, Inc. 2970 Bay Vista Ct., Benica, Calif. 94510. Prepreg thickness of around 0.005 inches ±0.002 inches have been found useful. In the shown embodiment, at Station 1 first 22 and second 24 sheets of a deformable material are interleaved with three sheets of release ply 26 to form a five layer sandwich (also refer to FIG. 11) which is introduced into Station 2. Release ply 26 is available from Airtech, Inc. 5700 Skylab Road, Huntington Beach, Calif. 92647. A release ply 26 thickness of around 0.001 inches has been found useful. The first 22 and second 24 sheets of deformable material are dispensed from first roller 28 and second roller 30 respectively, and release ply 26 is dispensed from third, fourth, and fifth rollers 29. Rollers 31 remove a backing form the first 22 and second 24 sheets of deformable material.

At Station 2 the five layer sandwich is corrugated by a first conveyor 32 having two counter-rotating belts 34 and 36. Belts 34 and 36 are constructed of interlocking rods 50 wherein each rod has a tooth 52 (also refer to FIG. 4). The teeth 52 of belt 34 mesh with the teeth of belt 36, so that as the five layer sandwich passes through first conveyor 32 the sandwich is corrugated by teeth 52.

At Station 3 first sheet 22 (which is now corrugated) is separated from second sheet 24 (which is also corrugated). The center layer of release ply 26 is removed, however a layer of release ply 26 remains attached to the top of first sheet 22 and to the bottom of second sheet 24. A layer of adhesive is then applied to the top of second sheet 24 by adhesive applicator 38, and then first sheet 22 and second sheet 24 are routed to Station 4.

At Station 4 first sheet 22 and second sheet 24 are connected by the adhesive as they pass through second conveyor 40. Second conveyor 40 has two counter-rotating belts 42 and 44. Belts 42 and 44 are also constructed of interlocking rods 50 wherein each rod has a tooth 52(also refer to FIG. 15). The teeth 52 of belt 42 aligns (does not mesh, but rather the top of the teeth 52 come together, refer also to FIG. 16) with the teeth of belt 44 so that as the first 22 and second 24 sheets pass through second conveyor 40 they are connected to form a double sheet which defines hollow honeycomb shape cells (a single layer honeycomb structure). Belts 42 and 44 also contain indexing teeth 78 (refer to FIG. 15) which ensure that the tooth to tooth alignment of second conveyor 40 is continuously maintained.

At Station 5 release ply 26 is removed from first sheet 22 and second sheet 24. A second adhesive applicator 46 applies a second adhesive to each single layer honeycomb sheet (sturcture) exiting Station 4. The single layer honeycomb structure is then cut by cutter 48 and stacked with a plurality of other similarly cut single layer honeycomb structures to form a honeycomb structure of a desired thickness (refer also to FIGS. 18–21).

Figure 2:
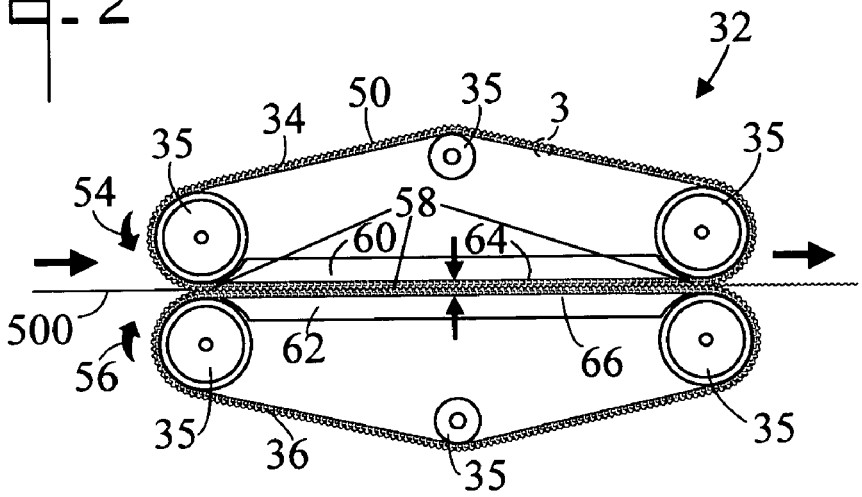
FIG. 2 is an enlarged side elevation view of a first conveyor (Station 2 of FIG. 1)

Now referring to FIG. 2, there is illustrated an enlarged side elevation view of first conveyor 32. First conveyor 32 includes first belt 34 of interlocking rods 50 (refer also to FIGS. 3 and 4). Each rod 50 has a tooth 52, which in the shown embodiment has a half-hexagonal shape. First belt 32 rotates in a first direction 54 (counterclockwise as shown). First conveyor 32 also includes a second belt 36 of interlocking rods 50 having teeth 52 having a half-hexagonal shape. Second belt 36 rotates in a second direction 56 (clockwise as shown) opposite from first direction 54. First 34 and second 36 belts form a first corridor 58 wherein teeth 52 of first belt 32 mesh with teeth 52 of second belt 36 (refer also to FIG. 7). First belt 34 and second belt 36 can traverse a radius such as around rubber coated drive rollers 35, but when laid flat in first corridor 58 they form the necessary half-hexagonal shape to produce a half-hexagon corrugated sheet.

When a sheet of deformable material 500 is passed through first corridor 58, the deformable material 500 is crimped into a corrugated half-hexagon shape by teeth 52 of first belt 34 and second belt 36. A pluralilty of corrugated sheets may then be connected by and adhesive to form a honeycomb structure.

First conveyor 32 includes a first heated pressure plate 60 which contacts first belt 34 in first corridor 58. First heated pressure plate 60 heats first belt 34 and urges first belt 34 toward second belt 36. In an embodiment of the invention, first heated pressure plate 60 comprises flat one inch thick pieces of aluminum having heat strips on their back side to evenly heat rods 50 and hence the deformable material 500. First conveyor 32 also includes a second heated pressure plate 62 which contacts second belt 36 in first corridor 58. Second heated pressure plate 62 heats second belt 36 and urges second belt 36 toward first belt 34. A first friction reducing material 64 (such as a sticky backed sheet of Teflon) is disposed between first heated pressure plate 60 and first belt 34, and a second friction reducing material 66 is disposed between second heated pressure plate 62 and second belt 36. The friction reducing material 64 and 66 ensures that rods 50 can traverse first corridor 58 with little resistance. The pressure and heat during passage through first corridor 58 facilitates the corrugation process.

Figure 3:
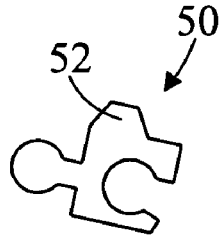
FIG. 3 is an enlarged view of area 3 of FIG. 2.

FIG. 3 is an enlarged view of area 3 of FIG. 2 showing an end view of one interlocking rod 50 having a tooth 52.

Figure 4:
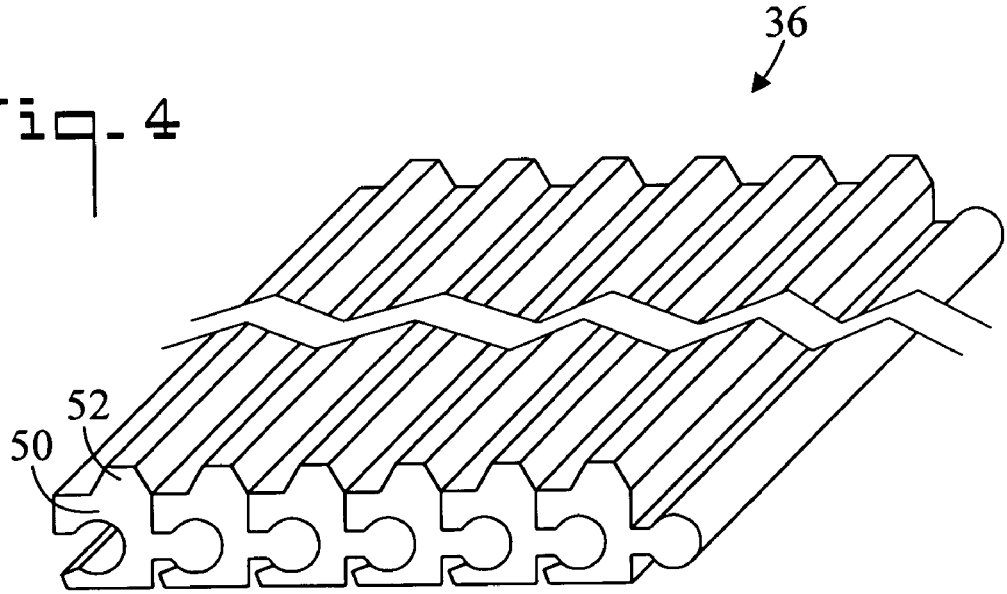
FIG. 4 is an enlarged fragmented perspective view of interlocking rods.

FIG. 4 is an enlarged fragmented perspective view of the interlocking rods 50 of second belt 36 in first corridor 58 (also refer to FIG. 3). In an embodiment of the invention interlocking rods 50 are extruded aluminum.

Figure 5:
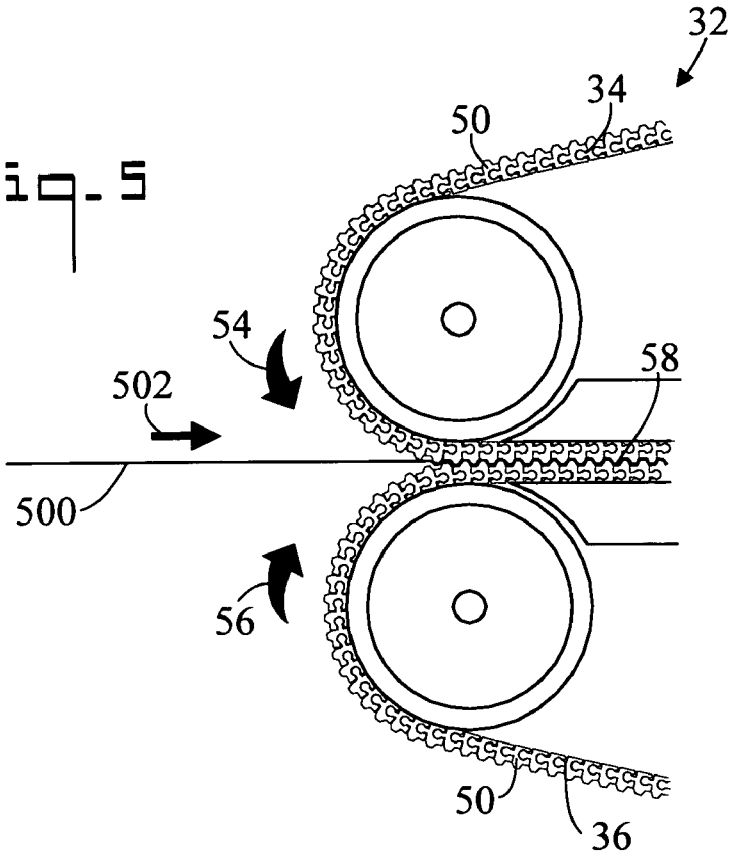
FIG. 5 is an enlarged fragmented side elevation view of the input portion of the first conveyor.

FIG. 5 is an enlarged fragmented side elevation view of the input portion of first conveyor 32. Deformable material 500 is feed in direction 502 between first belt 34 and second belt 36 and into first corridor 58.

Figure 6:
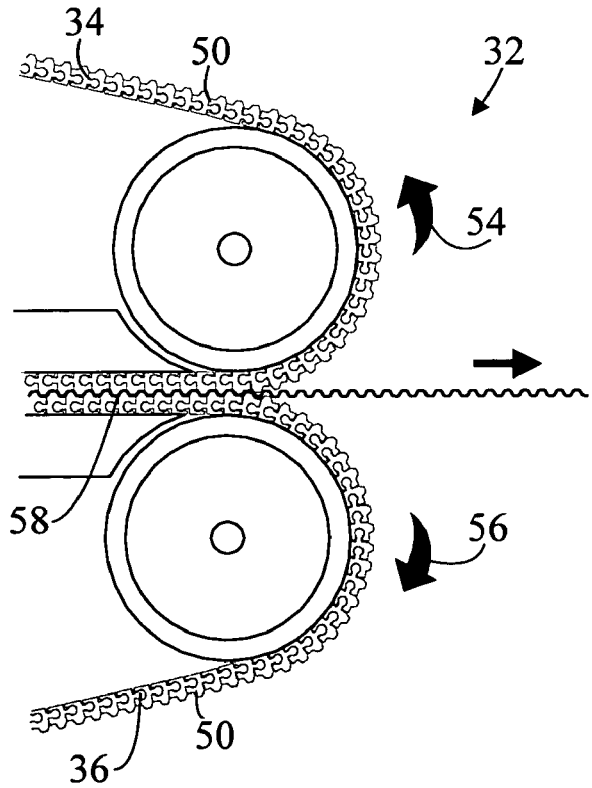
FIG. 6 is an enlarged fragmented side elevation view of the output portion of the first conveyor.

FIG. 6 is an enlarged fragmented side elevation view of the output portion of first conveyor 32. Deformable material 500 exits first corridor 58 in direction 502. Because the teeth 52 of first belt 34 mesh with the teeth 52 of second belt 36, deformable material 500 is corrugated as it passes through first corridor 58 (refer also to FIG. 7).

Figure 7:
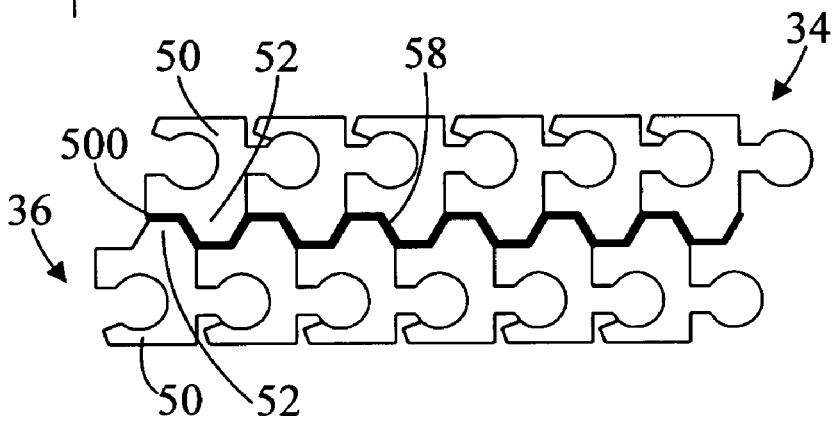
FIG. 7 is an enlarged side elevation view of a portion of a first corridor of the first conveyor.

FIG. 7 is an enlarged side elevation view of a portion of first corridor 58 of first conveyor 32 showing first belt 34, second belt 36, rods 50 and meshing teeth 52. The deformable material 500 is bent by the meshing teeth 52 into a corrugated shape.

Figure 8:
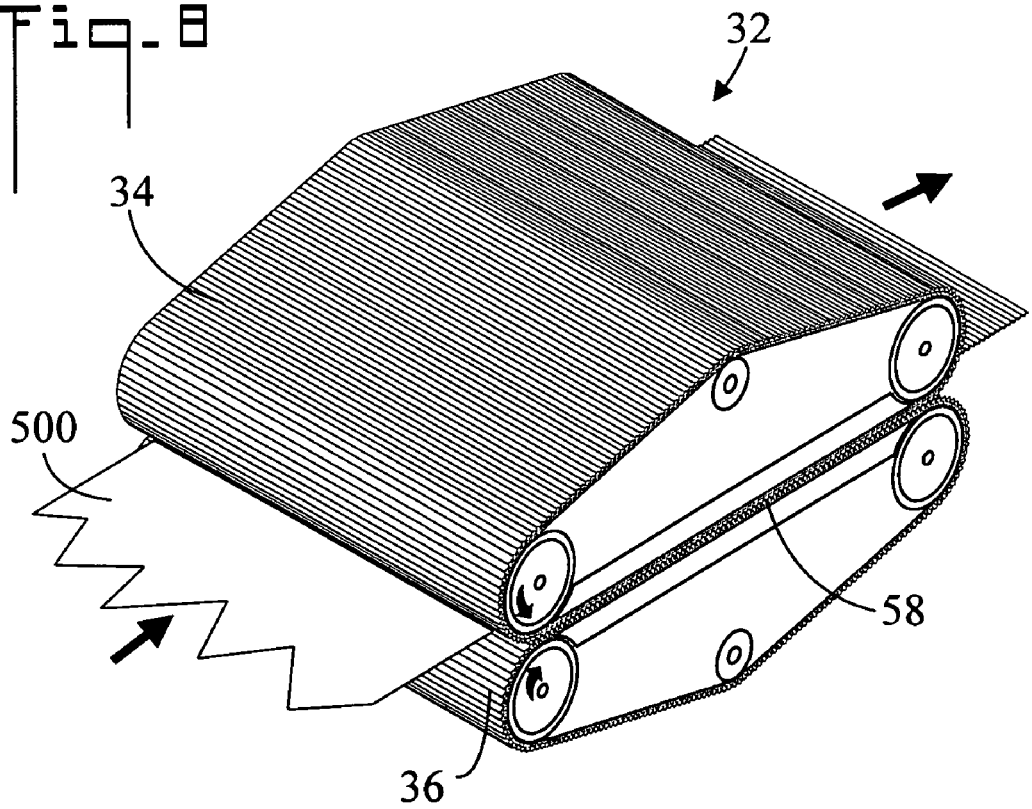
FIG. 8 is a perspective view of the first conveyor.

FIG. 8 is a perspective view of first conveyor 32 showing first belt 34, second belt 36, with sheet of deformable material 500 being feed into first corridor 58.

Figure 9:
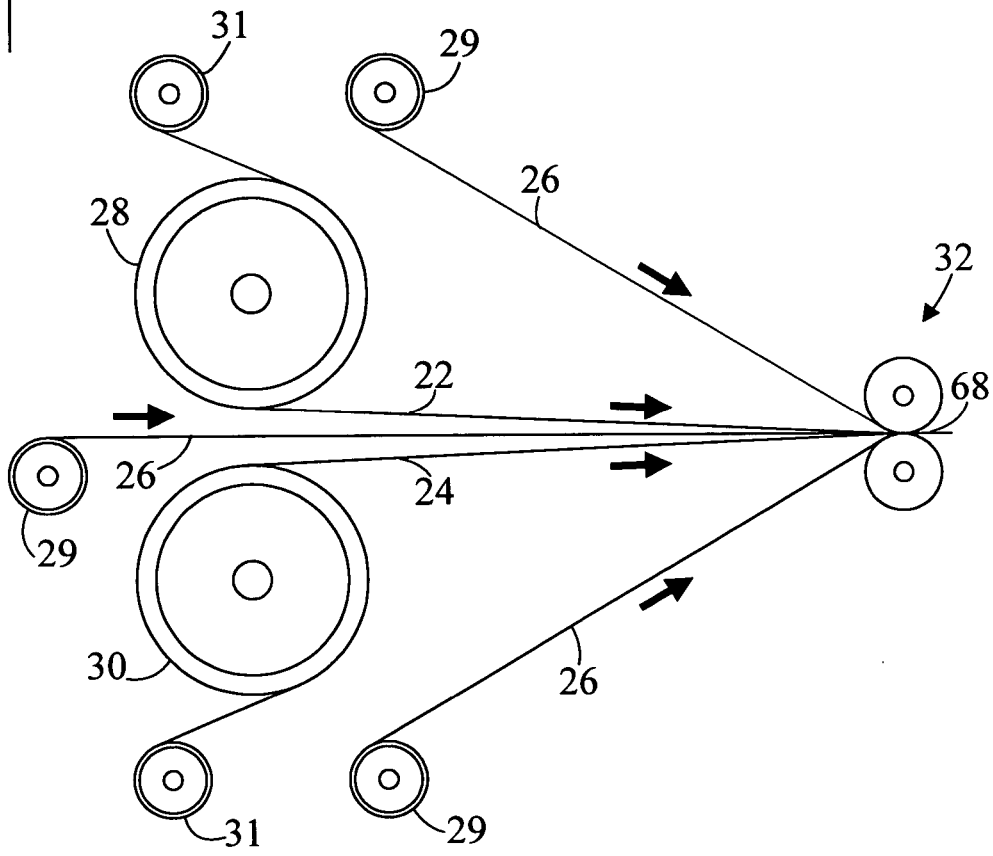
FIG. 9 is an enlarged side elevation view of Station 1 of FIG. 1.

FIG. 9 is an enlarged side elevation view of Station 1 of FIG. 1. System 20 includes first 28 and second 30 rollers which feed first 22 and second 24 sheets of deformable material into first corridor 58 of first conveyor 32 (also refer to FIG. 2). Third, fourth, and fifth rollers 29, feed the three layers of release ply 26 into first corridor 58 to create a five layer sandwich 68 (refer to FIGS. 10 and 11) which is then corrugated by first conveyor 32. Five layer sandwich 68 comprises first 22 and second 24 sheets of deformable material disposed between three layers of release ply 26 (refer to FIG. 11). The three layers of release ply 26 separate the two sheets of prepreg from each other as well as inhibit the bonding of the prepreg to the corrugation device of second conveyor 40. Rollers 31 collect a backing from deformable material before it enters first conveyor 32. Five layer sandwich 68 is then corrugated by first conveyor 32 as the sandwich passes through first corridor 58 (refer also to FIG. 12).

Prepreg is a material that combines fibers and resins in a homogeneous nature. It was designed originally to make composite structures more uniform and structurally predictable. For example most fiberglass boats were and sometimes and still are created by a method known as a wet lay-up; in which sheets of dry fiberglass fabric are placed on a mold or frame and a epoxy resin much like a basic glue is applied to create a rigid structure. For this example prepreg could be used in which the fiberglass fabric comes on a roll with a heat cured epoxy resin system pre-dispersed evenly throughout the fabric. The boat builder will now be able to know exactly how much resin and how much fabric is in each section of the boat yielding a boat with the optimum strength to weight ratio.

Prepreg commonly comes on a release paper (ply) that can be used in the corrugation process but if so desired the release paper can be removed and other release films can be used such as Tedlar or FEP. Using the release films such as the ones mentioned tends to yield a more accurate hexagonal geometry in the final block of core but increases final block costs. The apparatus of the present invention can corrugate a large range of prepregs fabrics composed of Fiberglass, Carbon fibers, Kevlar along with other exotic materials such as Spetra and PBO. These materials can be combined with many types of resin systems such as epoxies, cyanates, polyesters and ceramics, yielding a large variety of possible Honeycomb core materials.

Figure 10:
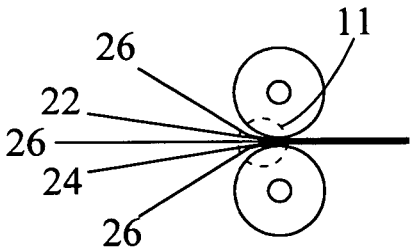
FIG. 10 is an enlarged side elevation view of a five layer sandwich.

FIG. 10 is an enlarged side elevation view of five layer sandwich 68 showing first 22 and second 24 sheets surrounded by release ply 26.

Figure 11:
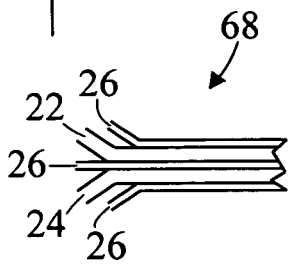
FIG. 11 is an enlarged view of area 11 of FIG. 10.

FIG. 11 is an enlarged view of area 11 of FIG. 10, showing five layer sandwich 68 as it enters first conveyor 32. As five layer sandwich 68 is passed through first corridor 58 of first conveyor 32, the entire five sheet sandwich 68 is corrugated, and then exists first conveyor 32 and is further processed at Station 3 (refer also to FIG. 1).

Figure 12:
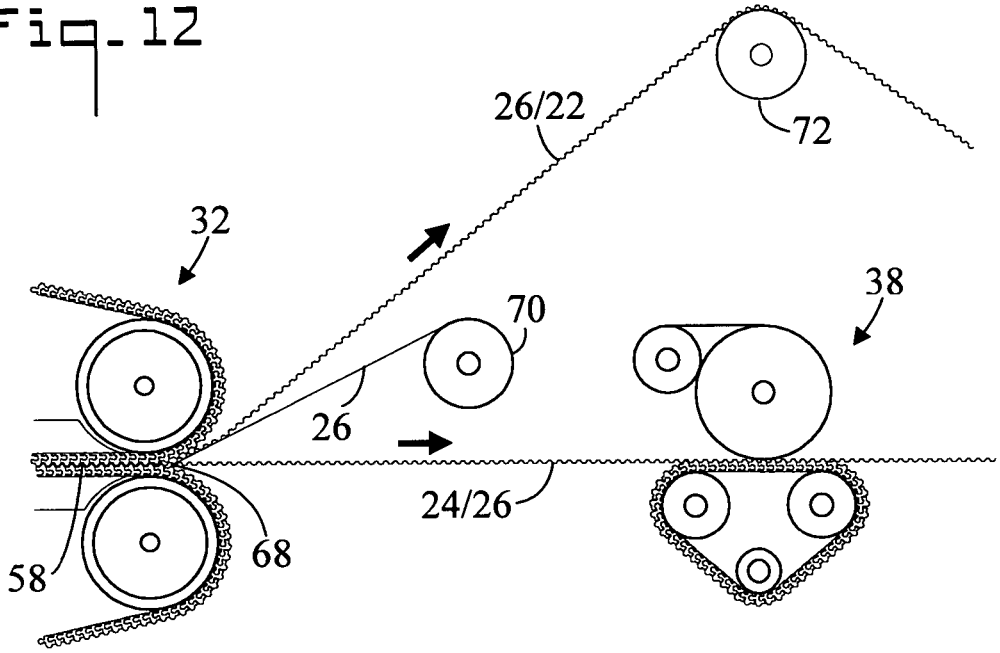
FIG. 12 is an enlarged side elevation view of Station 3 of FIG. 1.

FIG. 12 is an enlarged side elevation view of Station 3 of FIG. 1 wherein the corrugated first 22 and second 22 sheets of deformable material are separated and the central layer of release ply 26 is removed from five layer sandwich 68. System 20 includes a sixth roller 70 which collects the central layer of release ply 26 as the corrugated five layer sandwich 68 exists first corridor 58 of first conveyor 32. System 20 also includes a seventh roller 72 which separates corrugated first sheet 22 of deformable material and an attached layer of release ply 26 from the corrugated second sheet 24 of deformable material and an attached layer of release ply 26. The physical separation of first sheet 22 and second sheet 24 is necessary to allow clearance for the application of an adhesive (also called a node adhesive) to second sheet 24. System 20 further includes an adhesive applicator 38 which applies an adhesive to the corrugated second sheet 24 of deformable material. In an embodiment of the invention the adhesive is a resin film (refer also to FIG. 23 and the discussion pertaining thereto).

Figure 13:
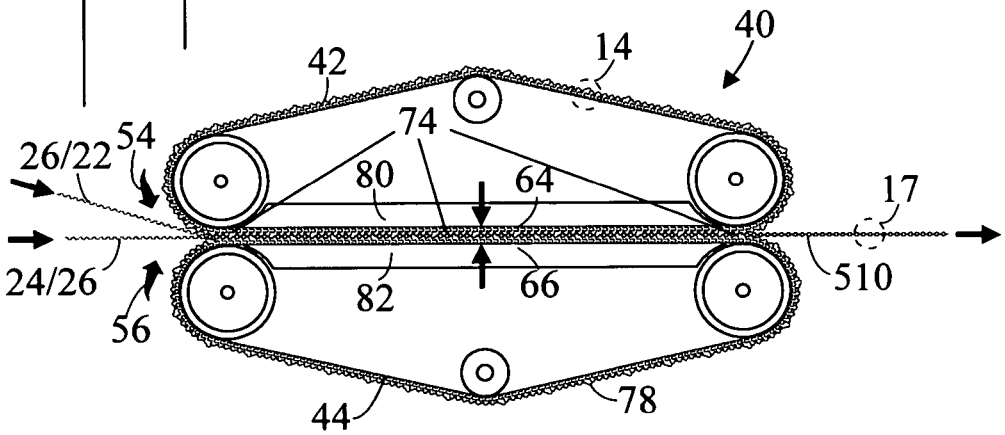
FIG. 13 is an enlarged side elevation view of a second conveyor.

Now referring to FIG. 13, there is illustrated an enlarged side elevation view of second conveyor 40. Second conveyor 40 includes third belt 42 of interlocking rods 50 (refer also to FIGS. 14 and 15). Each rod 50 has a tooth 52, which in the shown embodiment has a half-hexagonal shape. Third belt 42 rotates in a first direction 54 (counterclockwise as shown). Second conveyor 42 also includes a fourth belt 44 of interlocking rods 50 having teeth 52 having a half-hexagonal shape. Fourth belt 44 rotates in a second direction 56 (clockwise as shown) opposite from first direction 54. Third 42 and fourth 44 belts form a second corridor 74 wherein teeth 52 of third belt 42 align (not mesh) with teeth 52 of fourth belt 44 (refer also to FIG. 16). It is important to note that the alignment of teeth 52 of third belt 42 and fourth belt 44 of second conveyor 40 differs from the alignment of teeth 52 of first belt 34 and second belt 36 of first conveyor 32. In first conveyor 32 the teeth 52 mesh as is shown in FIG. 7. However in second conveyor 40 the teeth 52 align as is shown in FIG. 16. "Align" means that the teeth 52 are aligned along an axis 75 and therefore combine to form a hexagonal void 76 which produces the single layer honeycomb structure 510 of the present invention.

Figure 16:
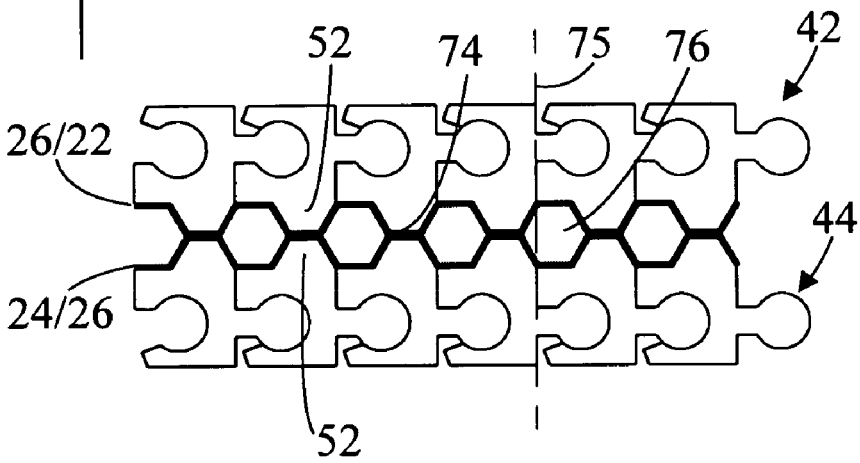
FIG. 16 is an enlarged side elevation view of a portion of a second corridor of the second conveyor.
Figure 17:
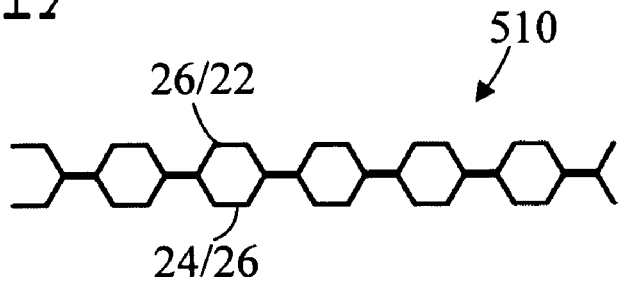
FIG. 17 is an enlarged side elevation view of the single layer honeycomb structure produced by the second conveyor.
Figure 18:
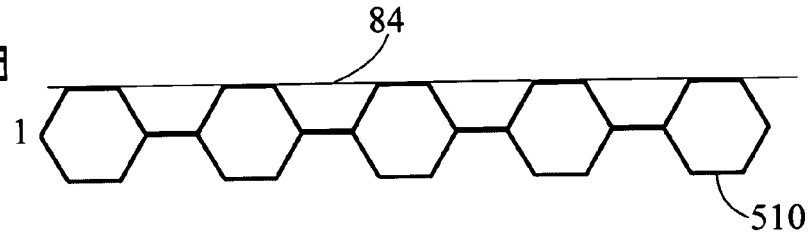
FIGS. 18 through 21 are enlarged side elevation views which depict the process of building a honeycomb structure of a desired depth.

When the corrugated first 22 and second 24 sheets of deformable material are simultaneously passed through second corridor 74, corrugated first sheet 22 of deformable material is joined by the adhesive (applied to second sheet 24 at Station 3) to corrugated second sheet 24 of deformable material to form a single layer honeycomb structure 510 as is shown in FIG. 17. That is the corrugated first 22 and second 24 sheets of deformable material occupy the hexagonal void 76 (refer also to FIG. 16) as they pass through second corridor 74, and therefore produce a single layer honeycomb structure 510.

Figure 14:
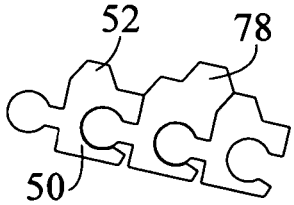
FIG. 14 is an enlarged view of area 14 of FIG. 13.
Figure 15:
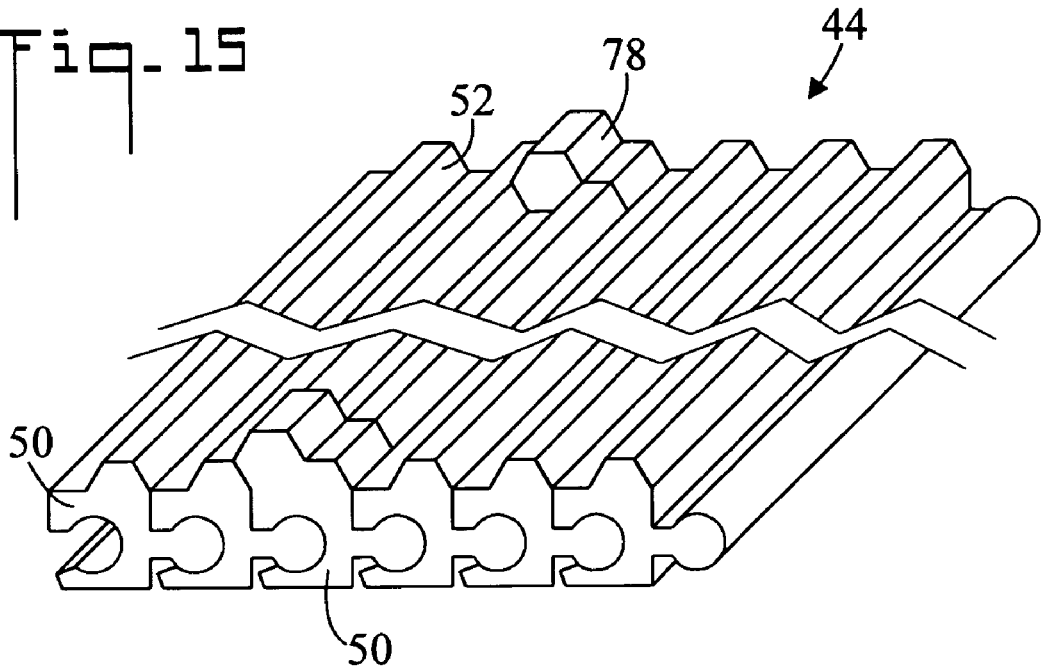
FIG. 15 is an enlarged fragmented perspective view of interlocking rods the second conveyor.

Third belt 42 and fourth belt 44 each include a plurality of rods 50 which have an indexing tooth 78 (refer also to FIGS. 14 and 15). In the shown embodiment, indexing teeth 78 are periodically spaced around third belt 42 and fourth belt 44. Indexing teeth 78 cause the teeth 52 of third belt 42 and fourth belt 44 to align rather than mesh (refer to FIG. 16). Indexing teeth 78 also have a half-hexagonal shape (refer to FIG. 15).

Second conveyor 40 includes a third heated pressure plate 80 which contacts third belt 42 in second corridor 74. Third heated pressure plate 80 heats third belt 42 and urges third belt 42 toward fourth belt 44. Second conveyor 40 also includes a fourth heated pressure plate 82 which contacts fourth belt 44 in second corridor 74. Fourth heated pressure plate 82 heats fourth belt 44 and urges fourth belt 44 toward third belt 42. As with first conveyor 32, a friction reducing material 64 and 66 is utilized easy to easy belt passage through second corridor 74. The pressure and heat cures the adhesive thereby ensuring that the two sheets are fixedly connected.

FIG. 14 is an enlarged view of area 14 of FIG. 13, showing interlocking rods 50 having teeth 52 and indexing tooth 78.

FIG. 15 is an enlarged fragmented perspective view of interlocking rods 50 of second conveyor 40. It is noted that indexing teeth 78 are only disposed on the outer edges of rods 50. This permits the corrugated first 22 and second 24 sheets to pass through the large area between the indexing teeth 78.

FIG. 16 is an enlarged side elevation view of a portion of second corridor 74 of second conveyor 40. Corrugated first 22 and second 24 sheets have been connected to form a single layer honeycomb structure 510 (also refer to FIG. 17). It is noted how the teeth 52 align rather than mesh as in FIG. 7. It is also noted that at this stage layers of release play 26 are still attached to the first 22 and second 24 sheets (refer also to FIG. 17).

FIG. 17 is an enlarged side elevation view of the single layer honeycomb structure 510 produced by second conveyor 40. First sheet 22 has been attached to second sheet 24 with the adhesive applied at Station 3. A layer of release ply 26 is disposed on top of first sheet 22, and another layer of release ply 26 is disposed on the bottom of second sheet 24.

At Station 5 (refer to FIG. 1) the continuous stream of double plied sheets which exit from Station 4 are cut to the final desired length. The next step in the process is to stack the cut sheets to form the final block of honeycomb core. First the release ply is removed from each side of the material. Then the double plied sheets are infused with a second resin system in which instead of adhering to just the nodes it is of a viscosity and rigidity such that is spans over the nodes as well as the space between the nodes. The double plied sheets with the top resin film are then stacked such that the sheets fall into each other. This process creates a unique honeycomb core that consists of cell walls that are two plies of prepreg and node contact points that are of 4 plies of prepreg. The entire block is then placed in an oven with a simple flat weight on the top to inflict a constant gravity based force down on to the curing core. The cure cycle will be such that the resin film bonding the double plies together as well as all of the prepreg will be fully cured. The end result is a block of honeycomb core that can be made at any standard cell size and can be cut to a desired thickness or machined down into a desired shape.

Figure 19:
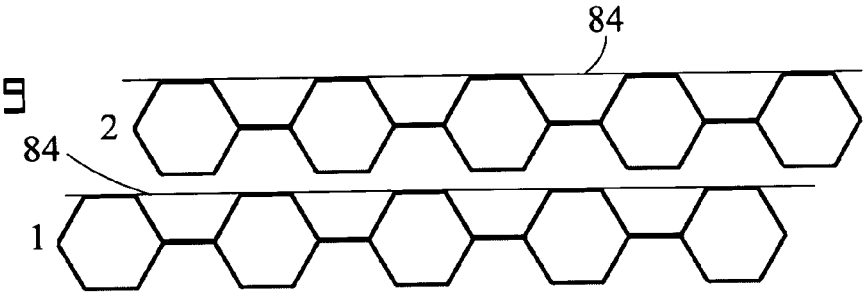
Figure 20:
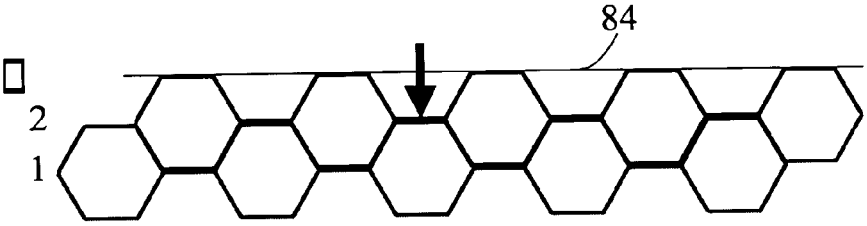
Figure 21:
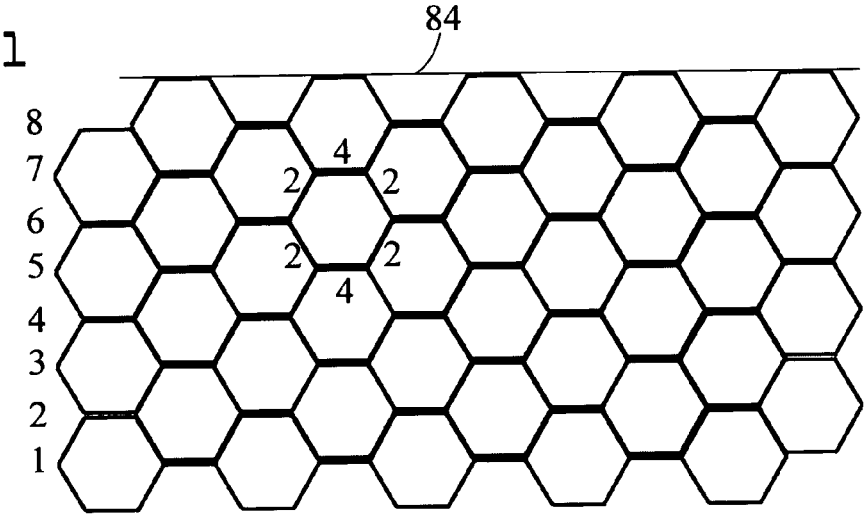

FIGS. 18 through 21 are enlarged side elevation views which depict the process of building a honeycomb structure of a desired depth (thickness) as is performed at Station 5 (refer to FIG. 1). First the two layers of release ply 26 are removed from the first single layer honeycomb structure 510 (1) which exists Station 4. Then a second adhesive 84 is applied to the top of the first single layer honeycomb structure (1), and the structure is cut to a desired length. In an embodiment of the invention, adhesive 84 is a sheet of resin film which includes a rubber additive. Next a similarly processed second honeycomb sheet (2) is positioned above first honeycomb sheet (1) as is depicted in FIG. 19. Then as shown in FIG. 20, a second single layer honeycomb structure (2) is meshed with first single layer honeycomb structure (1) wherein the adhesive bonds the two sheets together. It is noted that the single layer honeycomb structure do not align as at Station 4, but rather mesh as is shown in FIG. 20. The above process is repeated until a honeycomb structure of a desired thickness is achieved such as in FIG. 21. In FIG. 21, eight single layer honeycomb structures 510 have been connected. It is noted that the wall thickness of each of the honeycomb cells varies. Referring to FIG. 21, the two horizontal walls of each honeycomb cell are four layers of prepreg thick, while the four angled vertical walls are two layers of prepreg thick. The present invention can be used to create honeycomb structures have various cell sizes. Cell sizes of ⅛ inch, ⅜ inch, and ¼ inch have been found useful.

Figure 22:
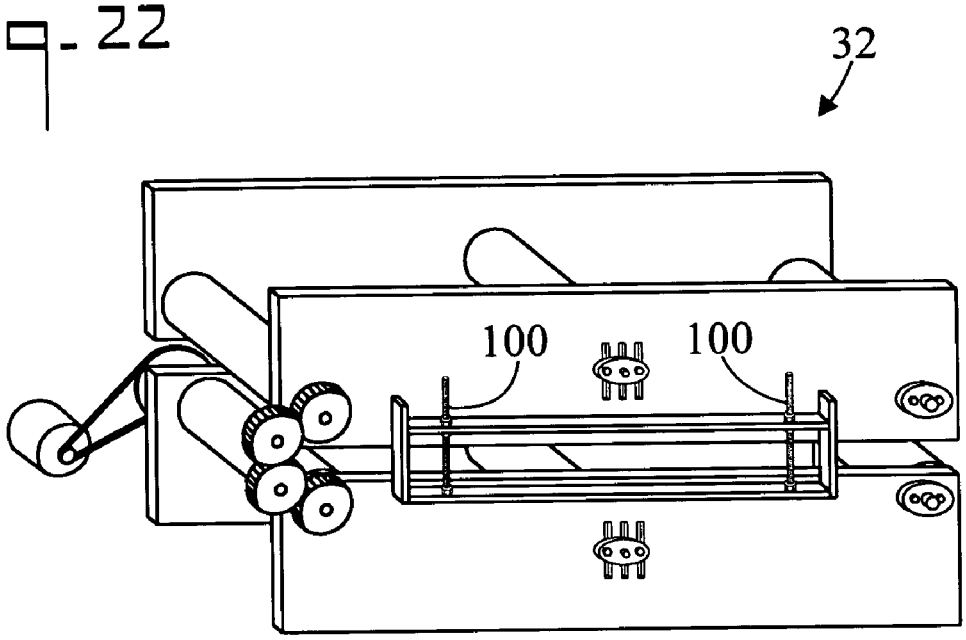
FIG. 22 is a perspective view of an embodiment of Station 2.

FIG. 22 is a perspective view of an embodiment of Station 2 (first conveyor 32). Pressure is maintained on the corrugated material by means of four large bolts 100. This pressure holds the corrugated material while the heat advances the resin allowing for the prepreg to gel. The gel point of a resin is when the viscous resin turns into a solid locking the material in its corrugated shape.

Figure 23:
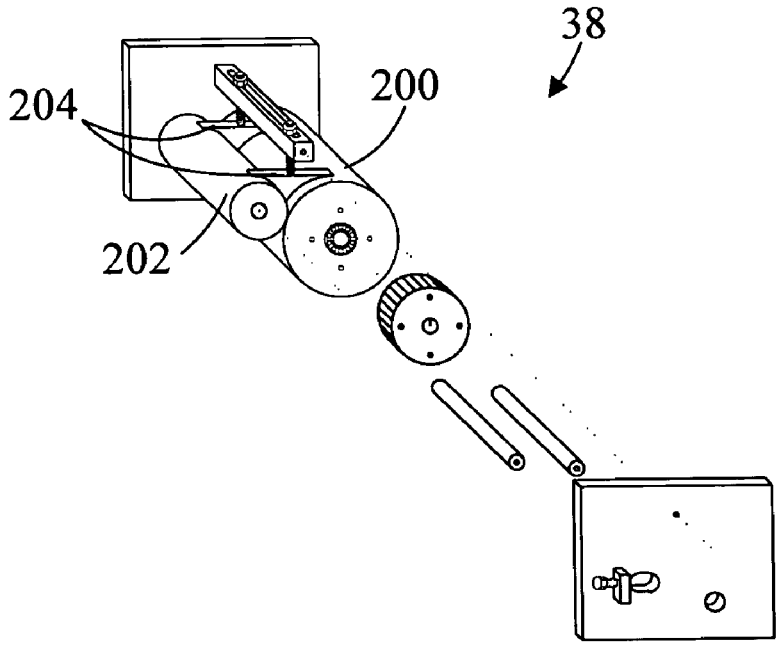
FIG. 23 is a perspective view of an embodiment of Station 3.

FIG. 23 is a perspective view of an embodiment of Station 3 (adhesive application 38). The adhesive applicator 38 is a simple device in which the exposed prepreg passes under a heated resin applicator roll 200. The heated resin applicator roll 200 is a steel roll heated with a fixed heating element traversing through the center of the roll. A smaller fixed resin bath roll 202 creates a pinching point in which only a certain thickness of resin film adhesive is allowed onto the application roll 200. Two wedges 204 at each end of the bath restrict the resin in the bath from flowing out of the sides. This process yields a controllable thickness of resin film that rolls onto the nodes (top wall) of the corrugated prepreg as it passes underneath but applies no adhesive into the valleys of the corrugated prepreg.

In terms of use, a method for producing a honeycomb structure includes:

(a) providing a first sheet 22 of deformable material stacked with a second sheet 24 of deformable material;

(b) providing a first conveyor 32 including:

a first belt 34 of interlocking rods 50, each rod 50 having a tooth 52, first belt 34 rotatable in a first direction 54;

a second belt 36 of interlocking rods 50, each rod 50 having a tooth 52, second belt 36 rotatable in a second direction 56 opposite from first direction 54;

first 22 and second 24 belts forming a first corridor 58 wherein the teeth 52 of the first belt 34 mesh with the teeth 52 of second belt 36;

(c) providing a second conveyor 40 including:

a third belt 42 of interlocking rods 50, each rod 50 having a tooth 52, third belt 42 rotatable in a first direction 54;

a fourth belt 44 of interlocking rods 50, each rod having a tooth 52, fourth belt 44 rotatable in a second direction 56 opposite from first direction 54;

third 42 and fourth 44 belts forming a second corridor 74 wherein the teeth 52 of third belt 42 align with the teeth 52 of fourth belt 44;

(d) passing first 22 and second 24 sheets of deformable material through first corridor 58 wherein first 22 and second 24 sheets of deformable material are corrugated by the teeth 52 of first 34 and second 36 belts;

(e) separating said corrugated first sheet 22 of deformable material from said corrugated second sheet 24 of deformable material;

(f) applying an adhesive to corrugated second sheet 24 of deformable material; and, (g) simultaneously passing corrugated first sheet 22 of deformable material and corrugated second sheet 24 of deformable material through second corridor 74 so that corrugated first sheet 22 of deformable material is joined by the adhesive to corrugated second sheet 24 of deformable material to form a single layer honeycomb structure.

The method further including:

in steps (b) and (c), teeth 52 having a half-hexagonal shape.

The method further including:

in step (b), first conveyor 32 including a first heated pressure plate 60 which contacts first belt 34 in first corridor 58, first heated pressure plate 60 heating first belt 34 and urging first belt 34 toward second belt 36; and, first conveyor including a second heated pressure plate 62 which contacts second belt 36 in first corridor 58, second heated pressure plate 62 heating second belt 36 and urging second belt 36 toward first belt 34.

The method further including:

in step (b), a first friction reducing material disposed 64 between first heated pressure plate 60 and first belt 34; and, a second friction reducing material 66 disposed between second heated pressure plate 62 and second belt 36.

The method further including:

in step (c), second conveyor 40 including a third heated pressure plate 80 which contacts third belt 42 in second corridor 74, third heated pressure plate 80 heating third belt 42 and urging third belt 42 toward fourth belt 44; and, second conveyor 40 including a fourth heated pressure plate 82 which contacts fourth belt 44 in second corridor 74, fourth heated pressure plate 82 heating fourth belt 44 and urging fourth belt 44 toward third belt 42.

The method further including:

in step (a), the deformable material being prepreg.

The method further including:

in step (c), third 42 and fourth 44 belts each including a plurality of rods 50 having an indexing tooth 78, indexing tooth 78 causing third 42 and fourth 44 belts to align rather than mesh.

The method further including:

indexing teeth 78 having a half-hexagonal shape.

The method further including:

in step (a), the deformable material including a five layer sandwich 68 having first 22 and second 24 sheets of deformable material disposed between three layers of release ply 26; and, prior to step (d), providing first 28 and second 30 rollers for feeding first 22 and second 24 sheets of deformable material into first corridor 58, and third, fourth and fifth rollers 29 for feeding release ply 26 into first corridor 58 to create the five layer sandwich 68, wherein the five layer sandwich 68 is corrugated by first conveyor 32.

The method further including:

after step (g), providing a sixth roller 70 which collects the central layer of release ply 26 as the corrugated five layer sandwich 68 exists first corridor 58;

in step (e), providing a seventh roller 72 which separates the corrugated first sheet 22 of deformable material from the corrugated second sheet 24 of deformable material; and, in step (f), providing an adhesive applicator 38 which applies the adhesive to the corrugated second sheet 24 of deformable material.

The method further including;

after step (g), removing a layer of release ply 26 from the corrugated first sheet 22 of deformable material, and removing a layer of release ply 26 from the corrugated second sheet 24 of deformable material: and, using an adhesive to attach a plurality of the single layer honeycomb structures of step (g) together.

Put another way, a method for producing a honeycomb structure includes:

(a) providing a first sheet 22 of deformable material stacked upon a second sheet 24 of deformable material;

(b) passing the stacked first 22 and second 24 sheets of deformable material through a first conveyer 32 wherein the first 22 and second 24 sheets of deformable material are corrugated by first conveyor 32;

(c) separating first sheet 22 of corrugated deformable material from second sheet 24 of deformable material as they exit first conveyor 32;

(d) applying an adhesive to second sheet 24 of deformable material; and, (e) passing first 22 and second 24 sheets of deformable material through a second conveyer 40 wherein corrugated first 22 and second 24 sheets of deformable material are connected to form a honeycomb structure.

The method further including:

(f) applying a second adhesive to the honeycomb structure of step (e);

(g) repeating steps (a) through (e) to produce a next honeycomb structure;

(h) applying a second adhesive to the next honeycomb structure; and, (i) placing the next honeycomb structure on top of the honeycomb structure so that the honeycomb structure and the next honeycomb structure are bound together.

The method further including:

repeating steps (g) through (i) a plurality of times until a desired honeycomb structure thickness is achieved.

The method further including:

steps (a) through (e) being performed as a continuous automated production process.

Another method for producing a honeycomb structure includes:

(a) providing a first sheet 22 of deformable material;

(b) providing a first conveyor 32 including:

a first belt 34 of interlocking rods 50, each rod having a tooth 52, first belt 34 rotatable in a first direction 54;

a second belt 36 of interlocking rods, each rod 50 having a tooth 52, second belt 36 rotatable in a second direction 56 opposite from first direction 54;

first 34 and second 36 belts forming a first corridor 58 wherein the teeth 52 of first belt 34 mesh with the teeth 52 of second belt 36;

(c) passing the first sheet 22 of deformable material through first corridor 58 wherein first sheet 22 of deformable material is corrugated by teeth 52 of first 34 and second 36 belts;

(d) providing a second sheet 24 of deformable material;

(e) passing the second sheet 24 of deformable material through first corridor 58 wherein second sheet 24 of deformable material is corrugated by teeth 52 of first 34 and second 36 belts; and, (f) connecting the first 22 and second 24 corrugated sheets to form a single layer honeycomb structure.

It is noted that in this embodiment of the present invention, the first 22 and second 24 sheets of deformable material are sequentially rather than simultaneously passed through the first corridor 58. This is in contrast to the continuous process embodiment of FIG. 1 wherein the first 22 and second 24 sheets are simultaneously passed through first corridor.

The method further including:

in step (b), teeth 52 having a half-hexagonal shape.

The method further including:

in step (b), first conveyor 32 including a first heated pressure plate 60 which contacts first belt 34 in first corridor 58, first heated pressure plate 60 heating first belt 34 and urging first belt 34 toward second belt 36; and, first conveyor 32 including a second heated pressure plate 62 which contacts second belt 36 in first corridor 58, second heated pressure plate 62 heating second belt 36 and urging second belt 36 toward first belt 34.

The method further including:

in step (b), a first friction reducing material 64 disposed between first heated pressure plate 60 and first belt 34; and, a second friction reducing material 66 disposed between second heated pressure plate 60 and second belt 36.

The method further including:

in step (a), the deformable material being prepreg.

A method for corrugating a sheet of deformable material includes:

(a) providing a first sheet 22 of deformable material;

(b) providing a first conveyor 32 including:

a first belt 34 of interlocking rods 50, each rod 50 having a tooth 52, first belt rotatable 34 in a first direction 54;

a second belt 36 of interlocking rods 50, each rod 50 having a tooth 52, second belt 36 rotatable in a second direction 56 opposite from first direction 54;

first 34 and second 36 belts forming a first corridor 58 wherein the teeth 52 of first belt 34 mesh with the teeth 52 of second bel 36*t*; and, (c) passing first sheet 22 of deformable material through first corridor 58 wherein first sheet 22 of deformable material is corrugated by the teeth 52 of the first 34 and second 36 belts;

The method further including:

in step (b), teeth 52 having a half-hexagonal shape.

The method further including:

in step (b), first conveyor 32 including a first heated pressure plate 60 which contacts first belt 34 in first corridor 58, first heated pressure plate 60 heating first belt 34 and urging first belt 34 toward second belt 36; and, first conveyor 32 including a second heated pressure plate 62 which contacts second belt 36 in first corridor 58, second heated pressure plate 62 heating second belt 36 and urging second belt 36 toward first belt 34.

The method further including:

in step (b), a first friction reducing material 64 disposed between first heated pressure plate 60 and first belt 34; and, a second friction reducing material 66 disposed between second heated pressure plate 62 and second belt 36.

The method further including:

in step (a), said deformable material being prepreg.

The preferred embodiments of the invention described herein are exemplary and numerous modifications, variations, and rearrangements can be readily envisioned to achieve an equivalent result, all of which are intended to be embraced within the scope of the appended claims.

I claim:

1. A method for producing a honeycomb structure, comprising:

(a) providing a first sheet of deformable material stacked upon a second sheet of deformable material;

(b) passing said stacked first and second sheets of deformable material through a first conveyer wherein said first and second sheets of deformable material are corrugated by said first conveyor;

(c) separating said first sheet of corrugated deformable material from said second sheet of deformable material as they exit said first conveyor;

(d) applying an adhesive to said second sheet of deformable material; and, (e) passing said first and second sheets of deformable material through a second conveyer wherein said corrugated first and second sheets of deformable material are connected to form a single layer honeycomb structure.

2. The method of claim 1, further including:

(f) applying a second adhesive to said honeycomb structure of step (e);

(g) repeating steps (a) through (e) to produce a next single layer honeycomb structure;

(h) applying a second adhesive to said next single layer honeycomb structure; and, (i) placing said next single layer honeycomb structure on top of said single layer honeycomb structure so that said single layer honeycomb structure and said next single layer honeycomb structure are bound together.

3. The method of claim 2, further including:

repeating steps (g) through (i) a plurality of times until a desired honeycomb structure thickness is achieved.

4. The method of claim 1, further including:

steps (a) through (e) being performed as a continuous automated production process.

5. A method for producing a honeycomb structure, comprising:

(a) providing a first sheet of deformable material stacked with a second sheet of deformable material;

(b) providing a first conveyor including:

a first belt of interlocking rods, each said rod having a tooth, said first belt rotatable in a first direction;

a second belt of interlocking rods, each said rod having a tooth, said second belt rotatable in a second direction opposite from said first direction;

said first and second belts forming a first corridor wherein said teeth of said first belt mesh with said teeth of said second belt;

(c) providing a second conveyor including:

a third belt of interlocking rods, each said rod having a tooth, said third belt rotatable in a first direction;

a fourth belt of interlocking rods, each said rod having a tooth, said fourth belt rotatable in a second direction opposite from said first direction;

said third and fourth belts forming a second corridor wherein said teeth of said third belt align with said teeth of said fourth belt;

(d) passing said first and second sheets of deformable material through said first corridor wherein said first and second sheets of deformable material are corrugated by said teeth of said first and second belts;

(e) separating said corrugated first sheet of deformable material from said corrugated second sheet of deformable material;

(f) applying an adhesive to said corrugated second sheet of deformable material; and, (g) simultaneously passing said corrugated first sheet of deformable material and said corrugated second sheet of deformable material through said second corridor so that said corrugated first sheet of deformable material is joined by said adhesive to said corrugated second sheet of deformable material to form a single layer honeycomb structure.

6. The method of claim 5, further including:

in steps (b) and (c), said teeth having a half-hexagonal shape.

7. The method of claim 5, further including:

in step (b), said first conveyor including a first heated pressure plate which contacts said first belt in said first corridor, said first heated pressure plate heating said first belt and urging said first belt toward said second belt; and, said first conveyor including a second heated pressure plate which contacts said second belt in said first corridor, said second heated pressure plate heating said second belt and urging said second belt toward said first belt.

8. The method of claim 7, further including:

in step (b), a first friction reducing material disposed between said first heated pressure plate and said first belt; and, a second friction reducing material disposed between said second heated pressure plate and said second belt.

9. The method of claim 5, further including:

in step (c), said second conveyor including a third heated pressure plate which contacts said third belt in said second corridor, said third heated pressure plate heating said third belt and urging said third belt toward said fourth belt; and, said second conveyor including a fourth heated pressure plate which contacts said fourth belt in said second corridor, said fourth heated pressure plate heating said fourth belt and urging said fourth belt toward said third belt.

10. The method of claim 5, further including:

in step (a), said deformable material being prepreg.

11. The method of claim 5, further including:

in step (c), said third and fourth belts each including a plurality of said rods having an indexing tooth, said indexing tooth causing said third and fourth belts to align rather than mesh.

12. The method of claim 11, further including:

said indexing teeth having a half-hexagonal shape.

13. The method of claim 5, further including:

in step (a), said deformable material including a five layer sandwich having said first and said second sheets of said deformable material disposed between three layers of release ply; and, prior to step (d), providing first and second rollers for feeding said first and second sheets of deformable material into said first corridor, and third, fourth and fifth rollers for feeding said release ply into said first corridor to create said five layer sandwich, wherein said five layer sandwich is corrugated by said first conveyor.

14. The method of claim 13, further including:

after step (g), providing a sixth roller which collects a central layer of said release ply as said corrugated five layer sandwich exists said first corridor;

in step (e), providing a seventh roller which separates said corrugated first sheet of deformable material from said corrugated second sheet of deformable material; and, in step (f), providing an adhesive applicator which applies said adhesive to said corrugated second sheet of deformable material.

15. The method of claim 14, further including;

after step (g), removing a layer of said release ply from said corrugated first sheet of deformable material, and removing a layer of said release ply from said corrugated second sheet of deformable material: and, using a second adhesive to attach a plurality of said single layer honeycomb structures of step (g) together.

* * * * *